United States Patent [19]

Williams

[11] 4,288,038

[45] Sep. 8, 1981

[54] WASTE MATERIAL PROCESSING APPARATUS

[76] Inventor: Robert M. Williams, 16 La Hacienda, Ladue, Mo. 63124

[21] Appl. No.: 104,750

[22] Filed: Dec. 17, 1979

[51] Int. Cl.[3] ..... B02C 13/288

[52] U.S. Cl. ..... 241/52; 241/62; 241/73; 241/81; 241/186.2

[58] Field of Search ..... 241/48, 57, 62, 32, 241/34, 73, 88.4, 81, 186.2, 52, 186 R, DIG. 38

[56] References Cited

U.S. PATENT DOCUMENTS

| | | | |
|---|---|---|---|
| 1,104,121 | 7/1914 | Knoblock | 241/81 X |
| 2,491,661 | 12/1949 | Gruendler | 241/82 |
| 2,844,184 | 7/1958 | Vollmer | 241/81 X |
| 2,931,581 | 4/1960 | Lykken et al. | 241/52 |
| 2,942,792 | 6/1960 | Anderson et al. | 241/14 |
| 3,082,963 | 3/1963 | Gondard | 241/82 |
| 3,283,698 | 11/1966 | Williams | 100/97 |
| 3,442,458 | 5/1969 | Meyer | 241/82 |
| 3,702,682 | 11/1972 | Williams | 241/81 X |

*Primary Examiner*—Mark Rosenbaum

*Attorney, Agent, or Firm*—Gravely, Lieder & Woodruff

[57] ABSTRACT

Apparatus for processing waste material which includes domestic and industrial waste, and in which the recovery of aluminum containers is an important aspect. The apparatus comprises a shredding mill and a housing structure to which the waste material is delivered in such manner that the difficult to shred heavy objects are allowed to separate by gravity action, and the remainder of the waste material is dispersed by an air stream such that the air responsive fractions are collected in a separator chamber and the remainder of the fractions are fed into the shredding mill under the control of gate means which responds to ability of the shredder to receive and process the same without overloading the motor drive.

10 Claims, 3 Drawing Figures

WASTE MATERIAL PROCESSING APPARATUS

BACKGROUND OF THE INVENTION

It has been apparent for sometime that valuable items of metal are being wasted by being discarded with other waste material, and in this category of metal items that fraction made up of aluminum is not susceptible of easy recovery as is the ferrous type which responds to magnetic separators. It is recognized that aluminum used in containers is an especially valuable source of that metal which if recoverable can be recycled so as to reduce the amount of energy related treatment for processing bauxite that is needed in the manufacture of aluminum used in the manufacture of containers.

The recovery of metal from waste material has been disclosed by Vollmer in U.S. Pat. No. 2,844,184 of July 22, 1958; by Anderson et al in U.S. Pat. No. 2,942,792 of June 28, 1960; by Williams in U.S. Pat. No. 3,283,698 of Nov. 8, 1966; and further by Williams in U.S. Pat. No. 3,702,682 of Nov. 14, 1972. The main purpose for the apparatus of the prior art has been focused on the recovery of magnetic material, or in the case of the Anderson disclosure of the sorting of aluminum scrap from other metals by a method calling for gravity separation thereof in a water suspension to recover light metal portions from scrap material and melting the recovered light metal by a so called "sweating process" in which an attempt is made to selectively melt the aluminum away from metallic contamination still mixed therewith. By and large, recovery apparatus has operated on the premise that magnetically responsive waste material is economically extracted from a moving stream by passing it adjacent magnetic separating devices and allowing the non-magnetic waste to pass on by. More recently apparatus specifically arranged to recover the aluminum fractions in metallic waste is disclosed in the application of Williams et al, Ser. No. 083,573 filed Oct. 11, 1979.

Other prior art apparatus is directed toward means for permitting the material shredder to either recirculate material or throw out hard to shred material, and cooperating means to direct the hard to shred material out of the shredding chamber. This prior art is represented by Knoblock U.S. Pat. No. 1,104,121 of July 21, 1914; Lykken et al U.S. Pat. No. 2,931,581 of Apr. 5, 1960; Gruendler U.S. Pat. No. 2,491,661 of Dec. 20, 1949; Gondard U.S. Pat. No. 3,082,963 of Mar. 26, 1963; and Meyer U.S. Pat. No. 3,442,458 of May 6, 1969.

The disposal of waste materials of all kinds and description in the past have been carried out by dumping in landfill areas and allowing destruction thereof by natural processes. The landfill disposal has worked in a satisfactory manner for materials that will disintegrate in time. That disposal operation does not take into account the fact that metals are slow to disintegrate, and that aluminum does not disintegrate and is therefore a troublesome component of waste. Landfill disposal operations are fast being shut down because it is recognized that a high proportion of the waste material contains heat values, that the ferrous metals can be reused, and the aluminum is a valuable source of that metal for recycling processes. However, these metals are reduced in value if iron or ferrous material contaminates the aluminum, or if aluminum contaminates the iron or ferrous material. The contamination of these metals is a problem with bimetal containers where ferrous and aluminum parts are used together.

BRIEF DESCRIPTION OF THE INVENTION

This invention relates to improvements in waste material recovery apparatus, and especially to apparatus for recovery of aluminum from waste material.

An important object of the present invention is to provide a waste material shredder with means in its feed chamber operable to retain the waste material in the orbit of the shredder until it is reduced to a desired condition for passage through an outlet grate, to control the feed of waste material to the shredder in response to the ability of the shredder to reduce the waste material in the orbit of the shredder, and to permit the circulation of hard to shred material back to the feed chamber where it may pass out of the feed chamber or be returned to the shredder.

A further object of the present invention is to provide improved apparatus which will effectively process waste material in such a way that the metallic fractions will be prepared for subsequent segregation by suitable means, and to provide means for especially preparing both the ferrous and aluminum fractions by shredding and balling action in a reducing mill.

Another object of the present improved apparatus is to arrange the several components in such a way that the waste material may be separated according to specific gravity characteristics, whereby the heavy fractions which usually consist of heavy ferrous metal is separated from the lighter ferrous and aluminum fractions which have a lesser specific gravity and which are then subjected to detailed shredding in preparation for subsequent recovery.

It is a further object of the present apparatus to provide means for regulating the load of waste material inside the shredding means so as to avoid overloading the drive means and additionally to safeguard both the shredder and drive means, effect a saving in energy, and produce a better processing of the waste material.

A preferred embodiment of the present waste material processing apparatus is exemplified by a structure forming a chamber having an inlet for waste material and an outlet spaced from said inlet; means at said chamber inlet for feeding waste material thereto; waste material reducing means connected to said chamber outlet for receiving and reducing waste material; waste material control means in said chamber in the path of movement of the waste material between said inlet and the reducing means, said control means including independently movable members operably carried in said chamber in the path of waste material movement, said members effectively dividing said chamber into a first space adjacent to said reducing means and a second space contiguous to said chamber inlet, whereby the agitation of waste material in said first space by said reducing means imposes a pressure on said movable members for limiting the feed of waste material toward said reducing means, and for releasing waste material for movement back to said second space for purposes of sorting into fractions not suitable for return to the first space and fractions acceptable for such return.

Other objects and advantages of the presently improved waste material processing apparatus will be set forth in the following detailed description thereof.

BRIEF DESCRIPTION OF THE DRAWINGS

The present invention is embodied in apparatus which is illustrated in the accompanying drawings, wherein.

DETAILED DESCRIPTION OF THE INVENTION

Figure 1:
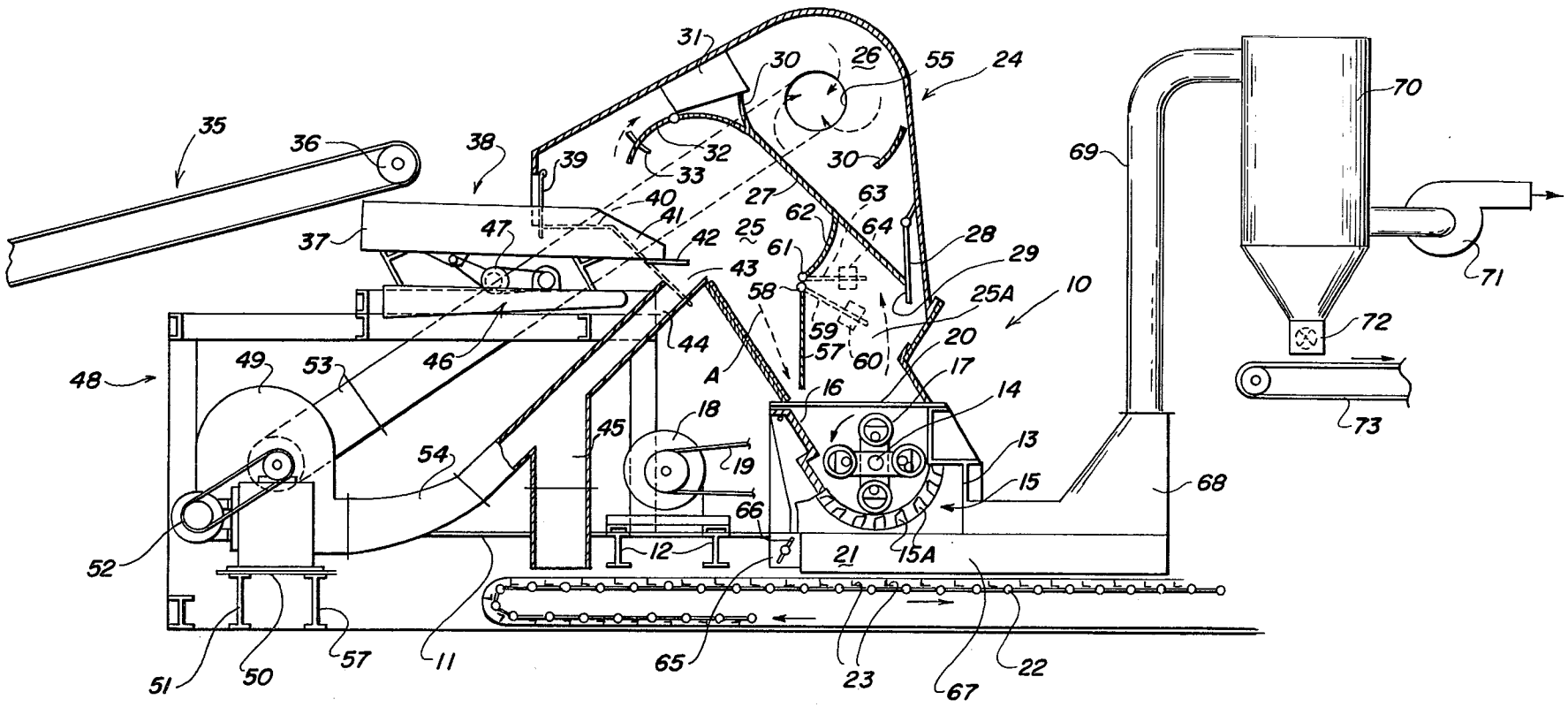
FIG. 1 is a side view of the apparatus in which portions of a material reducing mill are shown in sectional elevation and other portions are shown in elevation.

The view of FIG. 1 is a generally schematic view of the mill 10 in which certain parts have been illustrated in section to emphasize the portions of the mill of particular interest. In general the mill assembly has been disclosed in my prior U.S. Pat. No. 3,702,682 issued Nov. 14, 1972.

The structure of the mill 10 comprises a suitable base 11 having load bearing transverse members 12 which are positioned to support the mill housing 13 for the shredding rotor 14, grate bars 15 and a breaker member 16. The rotor 14 is provided with ring hammers 17 which are moved in a counter clockwise path through the drive motor 18 which is connected by a suitable drive belt 19. The housing 13 is formed with an inlet 20, while the outlet 21 below the grate bars 15 opens onto a conveyor belt 22 having cleats 23 presented to move the product passing the grate bars 15 in a rightward direction for further processing or collection or both.

A chambered structure 24 is mounted over the mill housing inlet 20 and provides a sorting chamber 25 and a cyclonic type separator chamber 26 divided by a common wall 27. The lower end of wall 27 cooperates with a pivoted damper 28 movable to open a passage 29 for releasing accumulated material thrown out by the cyclonic action taken place in the chamber 26 and caused to reenter the shredder housing 13. The cyclonic action in chamber 26 is developed with the aid of baffles 30. The entrance 31 to the chamber 26 is provided with an adjustable vane 32 having an arm (not shown) projecting through a slot 33 in the wall of housing 24 where an externally located device (not shown) is able to fix the vane as desired such that it forms a movable extension of the wall 27.

Material to be processed in the mill 10 is brought by a suitable belt conveyor 35 having its head drum 36 disposed to drop the material into the exposed end 37 of a vibratory feed pan 38. The pan 38 extends into the sorting chamber 25 past a suitable curtain 39 and between fixed baffles 40 (only one being shown). The spill-off end 41 of the pan 38 is provided with spaced tines 42 which are aligned over the mouth end 43 of a heavy object and tramp metal collecting conduit 44. Conduit 44 has a discharge chute 45 aligned over the conveyor 22 so that the objects falling through conduit 44 and chute 45 are combined with the material shredded by the rotor hammers 17 and made small enough to pass the grate bars 15. It is observed that the material dropped into the pan 38 undergoes a rapid shaking action through the drive 46 connected to the pan by an eccentric device 47.

A sub frame structure 48 is provided for a blower 49 carried on a platform 50 supported by beams 51. The blower has its rotor (not shown) driven by motor 52 such that air is drawn in through conduit 53 and is delivered at conduit 54. Conduit 53 has one end connected into the outlet eye 55 at the separator chamber 26, while the delivery conduit 54 is connected into the conduit 44 at one side of the chute 45. The blower 49 is operated to deliver a stream of air in the conduit at a suitable velocity to allow only the heavy chunky material to fall in the conduit counter to the air stream. A suitable velocity depends on the character of the make up of the material being processed, and may be of the order of 4000 FT/MIN. The object of the air flow in conduit 44 is to prevent light and intermediate weight material falling into the conduit, as well as to stir the material in chamber 25 and aid in its mixing and separation as it falls toward the entrance 20 to housing 13.

The present mill 10 is provided with means to control the movement from the area above the inlet 20 to housing 13 and thereby improve the operation of the mill, while affording protection for the drive motor 18 so as not to overload the same. The sorting chamber 25 is provided with a first vane or gate 57 carried on a shaft 58 mounted on suitable bearings (not shown) attached to the chamber walls. One end of shaft 58 projects to the exterior and has an arm 59 (shown in dotted) on which is adjustably mounted a counterweight 60. A second shaft 61 similarly mounted on the chamber walls carries a second vane or gate 62 inside the chamber 25, while an exterior end of the shaft 61 is connected to an arm 63 (shown in dotted) on which a counterweight 64 is adjustably mounted. The counterweights 60 and 64 may be positioned in a manner to regulate the responsive displacement of the respective gates 57 and 62 in relation to the operating conditions taking place in the chamber 25 and in the rotor housing 13 and in the space 25A across the entrance 20 and below the gates 57 and 62.

If it is assumed that a steady flow of material is moved off the end 41 of the vibratory pan 38, it can be understood that the heavy solids, like bricks, armatures, machinery and auto parts for example, will fall into the conduit 44 and pass through chute 45 to the conveyor. The light and intermediate weight materials, like cans, paper, plastic, rags and similar objects for example, will be projected by the air stream issuing from the conduit mouth 43 into chamber 25. This material will be sorted out and some fractions will gravitate into the space (see arrow A) above gate 57, while the action of blower 49 will draw the fractions of light weight material and floaters into and through channel 31 to space 26. The centrifugal action taking place there will cause this material to be thrown out and collect at the damper 28. When a sufficient weight of material has collected it will open the damper and fall directly into the shredding space 25A. The material will thereby be subjected to the action of the rotor rings 17 and be carried out through the grate bars 15. The air flow in chamber 26 will be substantially freed of the material and return by conduit 53 to the blower 49 for recirculation, whereby the blower will be protected from damage by solid material.

Concurrently with the activity caused by the blower 49 in chamber 26, the material fractions remaining in the sorting chamber 25 will fall into the space A at gate 57 and generally distribute itself substantially evenly across the horizontal width of gate 57. At the beginning of the mill operation the fractions falling onto gate 57 will force it open against counterweight 60 and pass into the rotor. As more fractions reach the rotor there will be rapidly moving circulation of such fractions across the grate 15 and back into the space 25A. The fractions may pass across the grate 15 several times until it has been balled up and reduced in size to pass between the grate bars 15A. The balling of the fractions is enhanced by the negative rake angle of the grate bars. It will happen that the space 25A will gradually fill with a mass of material constantly in movement, or in a boiling state of agitation. That movement will exert pressure against the gate 57 to oppose the entrance of fresh fractions until a balance is reached between material undergoing reduction and material trying to enter the space 25A for reduction. Should some fractions of the material be hard to reduce, the rotor hammers 17 will forceably eject the same passed gate 62 where it will travel along wall 27 and be directed by the position of the vane 32 into the vibratory pan 38. If this ejected fraction is heavy it will fall into conduit 44 and not return to chamber 25, otherwise, the ejected fraction will eventually reenter the rotor 14. It is also within the possibility of the mill operation that at certain times when the mill gets an excess of material, the rotor 14 will exert such a pressure that some of the fractions in boiling motion in space 25A will force open gate 62 and return to chamber 25. The action just referred to may be equivalent to the creation of hydraulic pressure by a fluid pump, and in that context the conditions taking place in the space 25A can be so described.

The important function of gate 57 and gate 62 is to meter the passage of material into and out of the rotor housing so as to allow the drive motor 18 to operate at a substantially even load in relation to the quantity of the material being delivered by conveyor 35. It is possible that the gate 57 will not be able to open due to the hydraulic pressure against it created by the material circulating in the space 25A above rotor 14, but as the material is reduced it will be able to open and allow more material to move into the orbit of rotor 14. The function of gate 62 has been explained above, and that is to allow hard to reduce objects to return to the vibratory pan 38 and have a second or subsequent opportunity to fall into conduit 44 through its mouth 43. Gate 62 also functions in response to the hydraulic pressure created by the circulation of material in the space 25A above rotor 14, and will open, thereby acting as a safety valve should loads become too severe on the shredder drive. Such material relieved in this way will recirculate along wall 27 thence fall onto the vibratory separator for air separation of heavy objects, and then fall back toward gate 57 to be metered back to the shredding chamber.

The apparatus of FIG. 1 is provided with means for elutriating the shredded product falling through the outlet 21 below the grate 15. This is accomplished by providing air moving means having an air inlet 65 controlled by a suitable valve 66 for the outlet 21, and a casing 68 having an open connection 67 at the housing 13. The casing 68 is open along its bottom over conveyor 22, and at the upper side is connected by conduit 69 to a bag house 70. The bag house 70 is provided with an exhaust blower 71 which exhausts substantially clean air to the outside. The material separated out in the bag house is metered out at rotary valve 72 onto a conveyor 73 where it can be collected for disposal in any suitable manner. The action of the blower 71 is to cause a flow of air across the shredded material in the outlet to sweep off or otherwise remove the fuzzy material, lint, shredded paper, and the like, and in that manner to clean up the shredded product which will drop onto conveyor 22.

Figure 2:
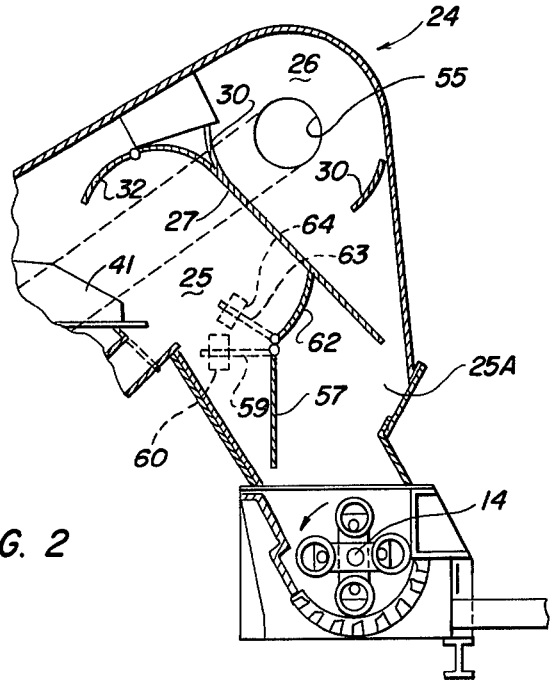
FIG. 2 is a fragmentary sectional view of modifications in the operating components of the present apparatus.

The modification seen in FIG. 2 incorporates the application of the counterweight 60' and arm 59' for assisting in opening gate 57. It is contemplated that this arrangement may be necessary when the gate 57 is made of material having a weight factor sufficient to resist opening for proper feed of the waste material into the rotor 14. The same condition may be encountered at gate 62, and in that case the arm 63' and the counterweight 64' are positioned to assist in opening gate 62. The counterweights 60' and 64' can be moved on the respective arms 59' and 63' to achieve the desired responsiveness of gates 57 and 62 in accordance with the foregoing control effect of the means in FIG. 1.

Figure 3:
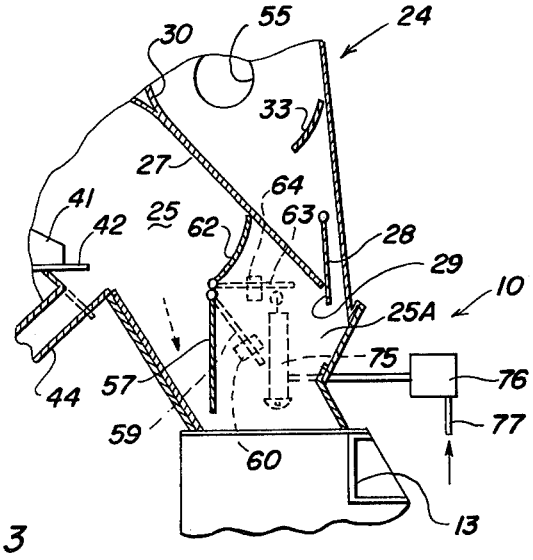
FIG. 3 is a fragmentary sectional view of a further modification of the present apparatus.

A further modification is seen in FIG. 3 where pneumatic motor means 75 may be employed to engage the arm 63 on gate 62 and open that gate periodically in accordance with a preselected time schedule located in the control means 76 inserted in the supply conduit 77. While the motor means 75 and control means 76 have been shown in operating relation to gate 62 of FIG. 1, it is understood that the gate 62' of FIG. 2 may be operated in a similar manner.

It can now be appreciated from the foregoing description and the structure illustrated in the drawings that the apparatus is directed to an improvement which comprises a reducing mill having an inlet for waste material to be processed, and an outlet for processed and reduced waste material, a chamber connected to the mill inlet and receiving waste material from feed means connected thereto, and operably mounted gate means disposed in the chamber spaced from the reducing mill inlet so as to occupy a position which divides the chamber into a first area for receiving waste material and a second area for trapping waste material adjacent the reducing mill. In such an improved arrangement the gate means operates to respond to the difference in the weight of waste material entering the first area from the feed means and the pressure of the circulation of waste material in the second area, which pressure is generated by the action of the reducing mill causing a rapid flow and boiling agitation of the waste material undergoing reduction. The gate means performs a novel function of establishing a substantially uniform loading of waste material into the second area so as to prevent overloading or stalling of the reducing mill, and wherein the gate means includes a first gate operable to open in a direction to pass waste material into the second area and a second gate operable to permit escape of waste material from the second area.

The foregoing specification has set forth the details of apparatus capable of performing the functions described, and in which certain improvements have been embodied for enhancing the processing of waste material so as to reduce the waste material into fractions which may be more easily separated by equipment beyond the discharge from the subject apparatus. It is of course appreciated that variations may come to mind once the details of the present disclosure are understood.

What is claimed is:

1. Waste material processing apparatus comprising: material reducing mill means having an outlet for reduced material; a waste material receiving chamber for directing waste material toward said mill means, said mill means operating to agitate the waste material and create a circulating flow thereof in said chamber during reduction thereof; and operable means mounted in said chamber in advance of said mill means and responsive to the waste material being circulated by said mill means, said operable means including a first gate means normally movable in a direction for admitting waste material to said mill means, and second gate means movable in a direction to release waste material circulated from said mill means, said first and second gate means operating to confine waste material to be reduced by said mill means and responding to the circulating flow thereof, so that said first gate means limits the quantity of waste material released to said mill means by withholding waste material in response to the back pressure of the flow of waste material being acted on by said mill means and said second gate means releases waste material back to said chamber for unloading said mill means of excess and hard to reduce waste material.

2. The apparatus of claim 1, wherein air moving means is connected at said reducing mill outlet for elutriating the reduced material issuing through said outlet.

3. The apparatus of claim 1, wherein said first and second gate means are pivotally mounted in said chamber for dividing said chamber into separate spaces, said first and second gate means having counterbalancing means for determining the operating positions thereof.

4. The apparatus of claim 1, wherein a separator chamber is positioned adjacent said receiving chamber and is in communication with said receiving chamber; air moving means is connected between said chambers for removing light weight waste material from said receiving chamber and releasing it in said separator chamber; and means is operably associated with said separator chamber for releasing said separated waste material to said reducing mill in by-pass of said gate means.

5. Waste material processing apparatus comprising: material reducing means having an outlet for processed material and an inlet for waste material; a waste material receiving chamber communicating with said inlet for said reducing means, said receiving chamber having a waste material feeding means and spaced outlets one of which is adjacent said feeding means; a separator chamber communicating with another one of said spaced outlets; air moving means having an inlet duct connected into said separator chamber and an outlet duct connected to said one of said spaced outlets for delivery of a stream of air into said receiving chamber for agitating waste material fed thereto by said feeding means while heavy waste material fractions move through said outlet duct counter to the stream of air; a chute connected to said outlet duct for directing the heavy waste fractions out of said outlet duct; and gate means in said receiving chamber in position between said inlet for said reducing means and said waste material feeding means, said gate means being responsive to the movement of waste material being processed by said reducing means, so that said gate means responds to the agitating pressure of the waste material being processed by said reducing means and selectively admits waste material to said reducing means and releases excess and hard to reduce waste material back to said receiving chamber for recirculation to said feeding means.

6. The apparatus set forth in claim 5, wherein said gate means comprises a pair of gates operably mounted in said receiving chamber in the path of waste material movement.

7. The apparatus set forth in claim 6, wherein counterweight control means is connected to each of said pair of gates.

8. The apparatus set forth in claim 5, wherein said outlet for processed material is formed with an air inlet, air moving means is connected to said outlet for directing a flow of ambient air substantially transversely of said outlet to elutriate the processed material, and conveyor means is positioned adjacent said air moving means to receive processed material.

9. In waste material processing apparatus, the combination which comprises: a material reducing mill having an inlet for waste material and an outlet for reduced waste material; a chamber connected to said mill inlet; waste material feed means connected to said chamber; and gate means operably disposed in said chamber spaced from said mill inlet in position to divide said chamber into a first area for receiving waste material and a second area for trapping waste material adjacent said mill inlet and concurrently respond to the difference in weight of waste material entering said first area from said feed means and the pressure of the circulation of waste material in said second area generated by said reducing mill, so that a substantially uniform loading of waste material on said reducing mill is established by the response of said gate means.

10. The improvement set forth in claim 9, wherein said gate means includes a first gate operable to open in a direction to pass waste material into said second area from said first area; and a second gate operable to permit escape of waste material from said second area to said first area.

* * * * *